United States Patent [19]

Mearns

[11] 4,401,388

[45] Aug. 30, 1983

[54] ROTATABLE CONNECTOR FOR BANGLE WRISTWATCH ATTACHMENT

[75] Inventor: Alec R. Mearns, Dundee, Scotland

[73] Assignee: Timex Corporation, Waterbury, Conn.

[21] Appl. No.: 373,323

[22] Filed: Apr. 29, 1982

[51] Int. Cl.[3] ..... G04B 37/00

[52] U.S. Cl. ..... 368/282; 224/167; 224/164; 63/3; 63/10

[58] Field of Search ..... 368/282; 63/3, 10, 21; 224/164–181

[56] References Cited

U.S. PATENT DOCUMENTS 253,017 1/1882 Diefenthaler ..... 63/10
2,771,768 11/1956 Tudor ..... 63/3

FOREIGN PATENT DOCUMENTS 2408322 7/1979 France ..... 224/167
2429571 1/1980 France ..... 224/164

*Primary Examiner*—Bernard Roskoski
*Attorney, Agent, or Firm*—William C. Crutcher

[57] ABSTRACT

A wristwatch having a bangle adapted for removable connection at one end to the lug on the wristwatch bezel, and for permanent rotatable connection at the other end. The invention comprises an improvement in the permanent connection comprising a plastic retainer held in the lug on the bezel. The bangle end is held via a "fir tree" interference fit with the plastic retainer upon assembly. The bangle is rotatable, yet provides a preferred orientation of the bangle and mild friction against rotation.

7 Claims, 4 Drawing Figures

ROTATABLE CONNECTOR FOR BANGLE WRISTWATCH ATTACHMENT

BACKGROUND OF THE INVENTION

This invention relates generally to a bangle wristwatch, and more particularly to improvements in the permanent connection between the bangle and the wristwatch bezel.

A bangle is defined herein as a bracelet partially encircling the wrist, usually of stiff or wire-like material, used as a fashionable means of holding a wristwatch, instead of a conventional strap or flexible watchband. Since a bangle is not expandable, nor does it usually have a center clasp, it is provided with a connection, which is removable where the bangle end attaches to the wristwatch. A bangle wristwatch attachment with a ball on either end of the bangle, which is held in sockets on lugs attached to the wristwatch bezel, is disclosed in French Patent Application No. 7734370 (Publication No. 2408322) filed Nov. 9, 1977 in the name of Miserez. This ball-and-socket connection allows one to slightly deform the bangle to remove the ball from the socket through a transverse hole or slot in the lug.

It has also been known in the prior art to provide a ball and socket at one end for a removable connection and a permanent, but rotatable, connection at the other end of the bangle. This invention concerns an improvement in the latter rotatable connection.

One type of prior art connection is provided by threading the end of the bangle and providing a threaded axial hole in the lug. The problem with this connection has been breakage by overtightening the bangle, and also the fact that free rotation of the bangle in the threaded hole does not provide any preferred orientation of the bangle with respect to the bezel, but lets it flop around freely.

Another type of rotatable fixed connection used in the prior art is one which provides a groove in the bangle end for receiving and a C-clip inserted from a transverse hole through the bezel lug. This retains the bangle end and still provides rotation. This type of connection is somewhat difficult to assemble, and does not provide any preferred orientation or mild friction of the bangle with respect to the bezel.

Accordingly, one object of the present invention is to provide an improved rotatable connection at the fixed end of the bangle in a bangle wristwatch.

Another object of the invention is to provide an improved bangle connection in a wristwatch which is easy to assemble and provides a preferred orientation, while being rotatable as well.

DRAWINGS

The invention, both as to organization and method of practice, together with further objects and advantages thereof, will best be understood by reference to the following description, taken in connection with the accompanying drawings, in which:

FIG. 1 is a perspective view of a bangle wristwatch of the type using the present invention, FIG. 2 is an enlarged elevation drawing, partly in section, showing the permanent and removable connections, FIG. 3 is a further enlarged cross-section of the permanent end connection of the bangle wristwatch, taken along lines 3—3 of FIG. 2, FIG. 4 is an enlarged cross-section, taken along line 4—4 of FIG. 3.

SUMMARY OF THE INVENTION

Briefly stated, the invention comprises an improvement in a wristwatch having a bezel with first and second lugs and a bangle having opposite ends connected to the respective lugs to hold the wristwatch on the wrist, one of said lug and bangle connections being removable and the other connection being permanent, said improvement comprising a first bangle end having a barbed or fir tree configuration thereon, a first lug on the bezel with an axial hole receiving the bangle end and having a transverse hole intersecting the axial hole, and a retainer of plastic material of a size and shape adapted to enter the transverse hole and having portions interfering with its withdrawal through the axial hole, said retainer having an interference hole therein receiving the barbed bangle end with an interference fit to prevent withdrawal of the retainer and bangle end from the lug.

DESCRIPTION OF THE PREFERRED EMBODIMENT

Figure 1:
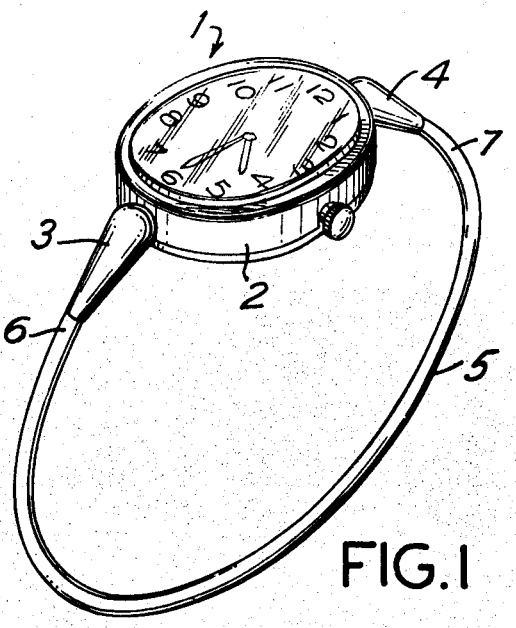

Referring now to FIG. 1 of the drawing, a bangle wristwatch comprises a conventional wristwatch 1 with a bezel 2 and first and second lugs 3 and 4 suitably attached to the bezel by welding or soldering. A bangle 5 has opposite ends 6, 7 held in the lugs 3, 4 respectively by means to be described. Bangle 5 may be a single wire or rod, shaped to partially encircle the wrist and being slightly resilient, so that it can be removed at the removable connection end.

Figure 2:
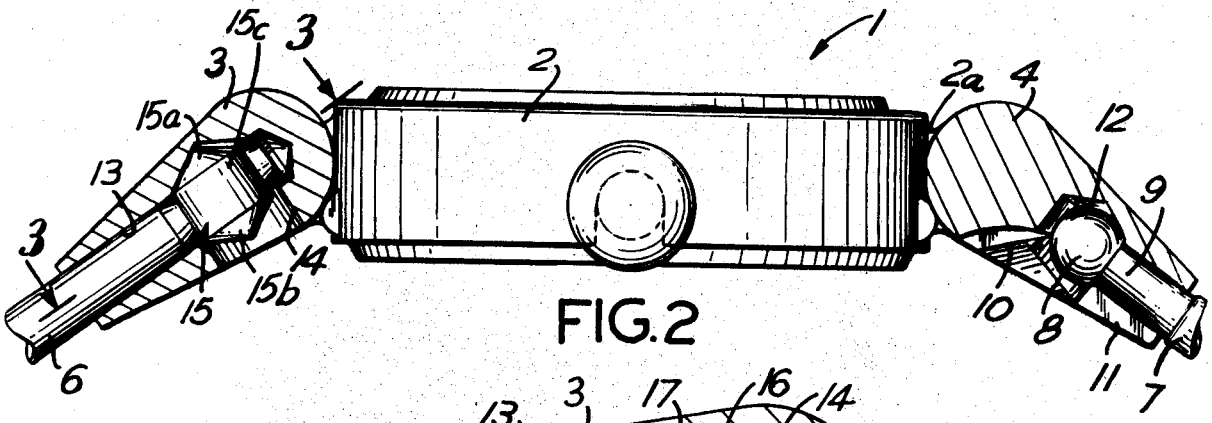

Reference to the elevation drawing of FIG. 2, shows that the end 6 of the bangle enters the first lug 3 to provide a fixed rotatable connection further to be described, and the other or removable end 7 of the bangle enters the second lug 4 to provide a removable connection.

The removable connection, which is not a critical feature of the present invention, comprises a ball 8 formed on the bangle end 7 and connected to the bangle proper by a cylindrical neck 9. A transverse hole 10 and a slot 11, the latter large enough for neck 9 but not large enough for the ball 8, provides for entry of ball 8 into a socket 12. This end of the bangle may be disconnected with ease by flexing the bangle to relieve the pressure on the ball and socket connection, in a manner which should be apparent.

Referring to the permanent connection end, which is the object of the present invention, the first lug 3 defines an axial hole 13 receiving the end 6 of the bangle. The lug 3 also includes a transverse hole 14 with a conical bottom extending partially through the lug and intersecting the axial hole 13. A special plastic retainer member 15, which is of such a dimension as to allow it to enter transverse hole 14, but to prevent withdrawal through the axial hole 13, retains the end of the bangle to prevent its withdrawal. The plastic retainer may be made of nylon or suitable homopolymer polypropylene, for example.

Figure 3:
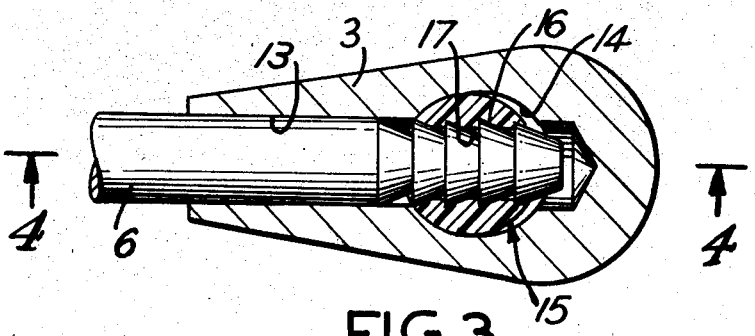
Figure 4:
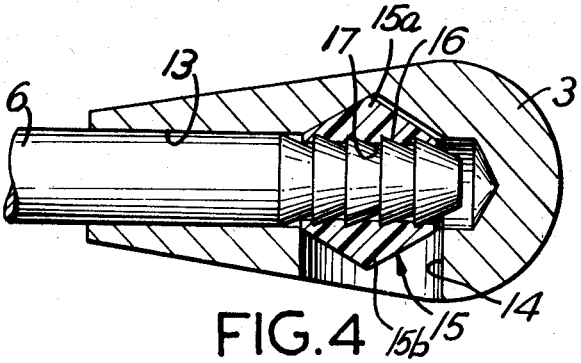

Referring to the cross-sectional views of FIGS. 3 and 4, the end of the bangle is formed in a barbed or fir tree configuration 16. The plastic retainer 15 includes a transverse interference hole 17 which is slightly undersized and adapted to receive the end of the bangle. The plastic material is deformable so that the barbed end may be inserted in the interference hole 17 and retained with an interference fit. It should be noted that the fir tree configuration on the bangle ensures a low assembly force combined with a high resistance to disassembly.

As best seen in FIG. 2, the plastic retainer 15 is of a special shape with conical ends 15*a*, 15*b* disposed on opposite sides of and coaxial with a cylindrical section 15*c*. The interference hole 17 runs through the retainer normal to the common axis of the conical and cylindrical sections of the retainer.

OPERATION

Operation of the invention is as follows. Assembly of the bangle end 6 to the lug 3 takes place by first inserting the plastic retainer 15 into the transverse hole 14 in the lug. By virtue of the conical end section 15*a* resting in the bottom of hole 14, the retainer may only rotate in the hole around its axis. This facilitates aligning the interference hole 17 in the plastic retainer with the end of the bangle (see FIG. 4).

Next, the barbed end 6 of the bangle is forcibly inserted into the hole 17 of the plastic retainer to deform the plastic and firmly hold the bangle end in the lug. When this is done, the plastic retainer 15 can no longer rotate about its axis. Rotation of the bangle is provided by rotation of the bangle end fir tree configuration within hole 17 of the plastic retainer. This provides a mild friction against rotation and assists in holding the bangle in a preferred orientation with respect to the bezel at such time when the free end 7 of the bangle is disconnected from the watch.

It only remains to note that the ball-and-socket connection to the free end is utilized to remove the wristwatch or to replace it. The permanent connection end allows rotation against mild friction to accommodate the wrist of the person wearing the watch and provides for ease of assembly, low cost easily produced parts, high strength and easy attachment by the wearer.

While there is disclosed what is considered to be the preferred embodiment of the invention, other modifications will occur to those skilled in the art, and it is desired to secure in the appended claims all such modifications as fall within true spirit and scope of the invention.

I claim:

1. In a wristwatch having a bezel with first and second lugs on opposite side thereof, and a bangle having first and second opposite ends connected to the respective lugs to hold the wristwatch on a wrist, one of said lug and bangle connections being adapted for disconnecting and the other connection being permanent, the improvement in said permanent connection comprising:

a first bangle end having a barbed configuration thereon, said first lug defining an axial hole receiving the first bangle end and defining a transverse hole intersecting said axial hole, and a retaining member of a size and shape adapted to enter the transverse hole and having portions interfering with its rotation or withdrawal through the axial hole, said retaining member having an interference hole therein receiving the first bangle end and forming an interference fit with said barbed configuration to prevent withdrawal of the retainer and bangle end from the first lug, and permitting rotation of the bangle end within said interference hole.

2. The improvement according to claim 1, wherein the barbed configuration comprises a "fir tree" portion, and wherein said retaining member is made of plastic material.

3. The improvement according to claim 1, wherein said retaining member includes a central cylindrical section with coaxial conical sections on either end thereof, said retainer hole being disposed in the cylindrical portion normal to the axis thereof.

4. The improvement according to claim 1, wherein said removable connection between the second bangle end and the second lug comprises a ball-and-socket arrangement, said lug having a slot to permit removal of the second bangle end from the second lug.

5. The improvement according to claim 1, wherein said retaining member is of a shape permitting rotation in the lug transverse hole in order to align the bangle end for assembly, but has portions preventing its rotation in the lug after the bangle end is in place, whereby the only rotation is between the bangle end and the retaining member.

6. The improvement according to claim 1, wherein the transverse hole in the first lug extends only partially therethrough and terminates in a conical bottom adapted to conform to a conical end on the retaining member.

7. In a wristwatch having a bezel with first and second lugs on opposite sides thereof and a bangle having first and second opposite ends connected to the respective lugs to hold the wristwatch on a wrist, the connection between the first lug and bangle end being rotatably fixed, and the connection between the second lug and bangle end comprising a ball-and-socket connection with a ball on the second bangle end removable from a slot in the second lug, the improvement in the rotatably fixed connection comprising:

a first bangle end having a fir tree configuration on the end thereof, the first lug defining an axial hole receiving said first bangle end and a transverse hole intersecting said axial hole and extending partially through the lug to terminate in a conical bottom, a plastic retaining member having a cylindrical section and opposite coaxial conical end sections with the cylindrical section disposed in the transverse hole and one conical portion in the bottom thereof, said retaining member having an interference hole extending through the cylindrical section and receiving the fir tree portion of the first bangle end with an interference fit to prevent withdrawal of the retaining member and bangle end portion from the lug, said plastic material providing for rotation of the fir tree portion of the bangle therein.

* * * * *